US007170461B2

(12) United States Patent
Parsche

(10) Patent No.: US 7,170,461 B2
(45) Date of Patent: Jan. 30, 2007

(54) CONICAL DIPOLE ANTENNA AND ASSOCIATED METHODS

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 11/121,617

(22) Filed: May 4, 2005

(65) Prior Publication Data

US 2006/0250315 A1 Nov. 9, 2006

(51) Int. Cl.
*H01Q 13/00* (2006.01)

(52) U.S. Cl. ..... 343/773; 343/774; 343/807

(58) Field of Classification Search ..... 343/773, 343/774, 800, 807, 808, 786
See application file for complete search history.

(56) References Cited

U.S. PATENT DOCUMENTS 2,175,252 A 10/1939 Carter
2,368,663 A 2/1945 Kandoian
2,476,469 A * 7/1949 Walker ..... 343/823
3,618,107 A 11/1971 Spanos
3,737,906 A * 6/1973 Maynard ..... 343/705
4,143,377 A * 3/1979 Salvat et al. ..... 343/755
5,506,592 A * 4/1996 MacDonald et al. ..... 343/846
5,990,845 A * 11/1999 Sharp et al. ..... 343/846

* cited by examiner

*Primary Examiner*—Hoanganh Le
(74) *Attorney, Agent, or Firm*—Allen, Dyer, Doppelt, Milbrath & Gilchrist, P.A.

(57) ABSTRACT

The dipole antenna includes a first antenna element assembly and a second antenna element assembly arranged in a dipole antenna configuration. The first antenna element assembly has one or more conical antenna elements, and the second antenna element assembly has a series of conical antenna elements with each successive conical antenna element at least partially within a prior conical antenna element. Each of the first and second antenna dipole assemblies may also include a respective disk antenna element and a filament antenna element. The antenna has a stable beamwidth and broad bandwidth over a range of frequencies.

30 Claims, 6 Drawing Sheets

CONICAL DIPOLE ANTENNA AND ASSOCIATED METHODS

FIELD OF THE INVENTION

The present invention relates to the field of antennas, and more particularly, this invention relates to small broadband antennas, and related methods.

BACKGROUND OF THE INVENTION

Newer designs and manufacturing techniques have driven electronic components to small dimensions and miniaturized many communication devices and systems. Unfortunately, antennas have not been reduced in size at a comparative level and often are one of the larger components used in a smaller communications device. In those communication applications at below 6 GHz frequencies, the antennas become increasingly larger. In the 3 to 30 Mhz HF region for example, used by military, the proffered antennas become very large relative to operating platforms. A ¼ wave whip antenna for 5 Mhz is about 50 feet tall, and this is obviously unacceptable for use on a vehicle, and even fixed antennas require wire cage structures. It becomes increasingly important in these communication applications to reduce not only antenna size, but also to design and manufacture a reduced size antenna having a relatively broad gain bandwidth for a relatively small volume.

In current everyday communications devices, many different types of capacitor structures are used as antennas, which are the dipole antennas, the forms of which include the wire doublets, biconical dipoles, conical monopoles, discone antennas, and patch antennas. These are realized in a variety of different implementations. These antennas, however, are sometimes impractically large for the desired instantaneous bandwidth.

Conical antennas, which include a single inverted cone over a ground plane, and biconical antennas, which include a pair of cones oriented with their apexes pointing toward each other are used as broadband antennas for various applications, for example, direction finding. Referring to FIG. 1, a biconical antenna 10 includes a top inverted cone 12, a bottom cone 14 and a feed structure 16, as disclosed in U.S. Pat. No. 2,175,252 to Carter entitled "Short Wave Antenna". An electronic coupler provides a connection to a feeding circuit that provides an electrical signal that feeds the antenna. The antenna is symmetric about the cone axis and each of the cones is a full cone, spanning 360°. Referring to FIG. 2, the antenna pattern beamwidth of a conventional biconical antenna is diagrammatically illustrated. As can be seen in the diagram, the beamwidth decreases as frequency increases. This may be undesirable for various applications.

Similarly, a single cone antenna includes a single antenna cone that also spans 360° and is symmetric about the cone axis. A single antenna cone is connected to an electronic coupler that provides a connection to a feeding circuit that provides an electrical signal to feed the antenna. The single cone antenna is located over a ground plane.

For example, U.S. Pat. No. 6,198,454 to Sharp et al. is directed to a broadband partial fan cone antenna. The antenna includes a radiator having a partial cone shape. U.S. Pat. No. 2,235,506 to Schelkunoff entitled "Ultra Short Wave Radio System", describes the spheroidal and ellipsoidal geometries of single dipole doublets, having single resonant response. Multiple tuned responses, in which the antenna has a filter like polynomial response may be desirable in some applications.

Ultimately, there is a need for capacitive or dipole family antennas with greater instantaneous bandwidth, smaller size and stable beamwidth.

SUMMARY OF THE INVENTION

In view of the foregoing background, it is therefore an object of the present invention to provide a broadband dipole antenna with stable beamwidth over a frequency range.

This and other objects, features, and advantages in accordance with the present invention are provided by a dipole antenna including a first antenna element assembly and a second antenna element assembly arranged in a dipole antenna configuration. The first antenna element assembly includes at least one conical antenna element, and the second antenna element assembly includes a series of conical antenna elements with each successive conical antenna element at least partially within a prior conical antenna element. Preferably, the first antenna assembly also includes a series of conical antenna elements with each successive conical antenna element at least partially within a prior conical antenna element.

The series of conical antenna elements of the first and second antenna element assembly respectively comprise coaxially aligned conical antenna elements sharing a common apex, and may each include a same number of conical antenna elements arranged in a symmetrical pattern. Each of the first and second antenna dipole assemblies may further include a respective disk antenna element and/or a respective filament antenna element.

Preferably, outer edge portions of the first and second antenna element assemblies lie along a common imaginary spherical surface, and an antenna feed point is between the first and second antenna element assemblies, with the imaginary spherical surface being centered on the antenna feed point. A coaxial antenna feed includes an outer conductor connected to the first antenna element assembly, and an inner conductor connected to the second antenna element assembly. Also, each of the conical antenna elements may have a continuous conductive surface or be formed as a wire structure.

A method of making a dipole antenna includes arranging a first antenna element assembly and a second antenna element assembly in a dipole antenna configuration. Again, the first antenna element assembly includes at least one conical antenna element, and the second antenna element assembly includes a series of conical antenna elements with each successive conical antenna element at least partially within a prior conical antenna element. Preferably, the first antenna assembly comprises a series of conical antenna elements with each successive conical antenna element at least partially within a prior conical antenna element.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 3:
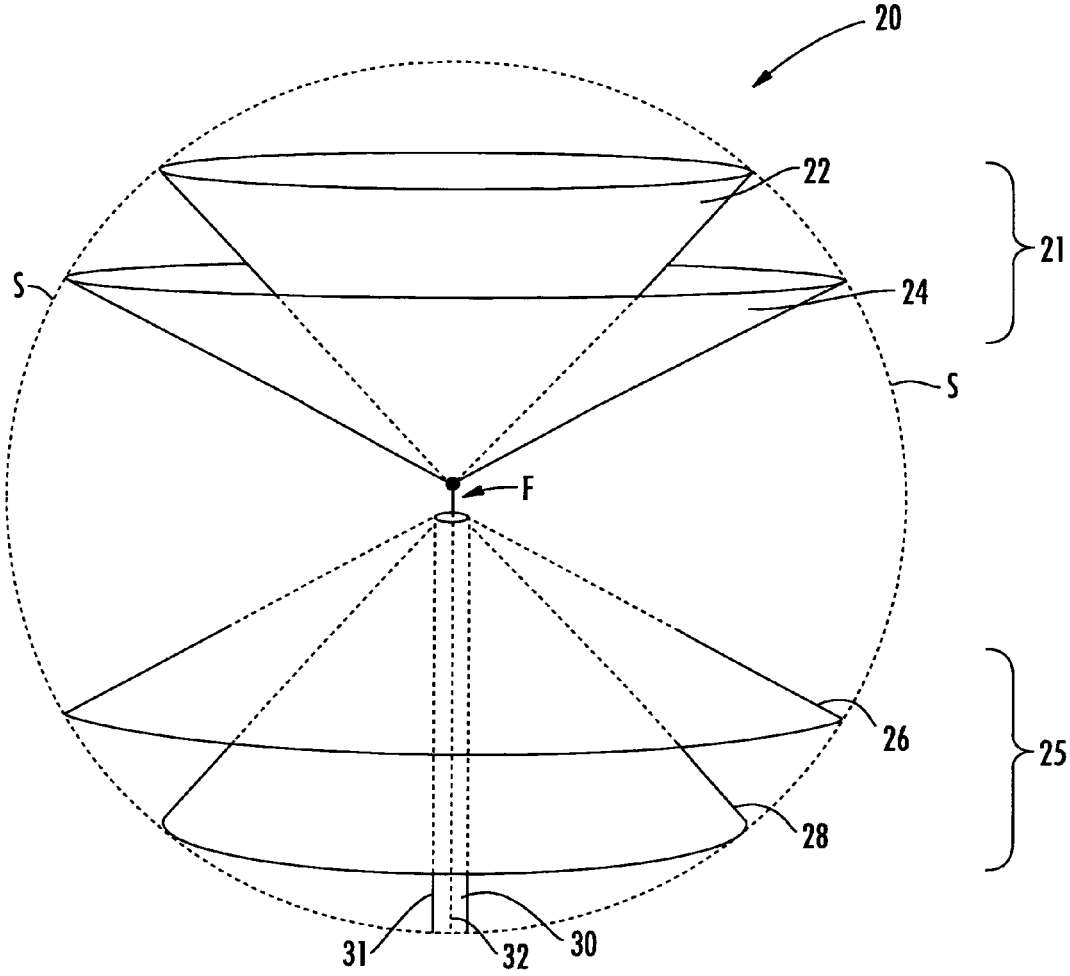
FIG. 3 is a schematic diagram of a dipole antenna according to the present invention.

Referring initially to FIG. 3, a dipole antenna 20 according to a first embodiment of the present invention will now be described. The dipole antenna 20 includes a first antenna element assembly 25 and a second antenna element assembly 21 arranged in a dipole antenna configuration. The first antenna element assembly 25 includes at least one conical antenna element 26, and the second antenna element assembly 21 includes a series of conical antenna elements 22, 24 with each successive conical antenna element at least partially within a prior conical antenna element. Preferably, and as shown, the first antenna assembly 25 also includes a series of conical antenna elements 26, 28 with each successive conical antenna element at least partially within a prior conical antenna element.

The series of conical antenna elements of the first and second antenna element assemblies 25, 21 respectively comprise coaxially aligned conical antenna elements sharing a common apex, and may each include a same number of conical antenna elements arranged in a symmetrical pattern. Preferably, outer edge portions of the first and second antenna element assemblies 25, 21 lie along a common imaginary spherical surface S, and an antenna feed point F is between the first and second antenna element assemblies, with the imaginary spherical surface being centered on the antenna feed point. A coaxial antenna feed 30 includes an outer conductor 31 connected to the first antenna element assembly 25, and an inner conductor 32 connected to the second antenna element assembly 21. Also, each of the conical antenna elements may have a continuous conductive surface, such as a copper sheet, or be formed as a wire structure.

Figure 4:
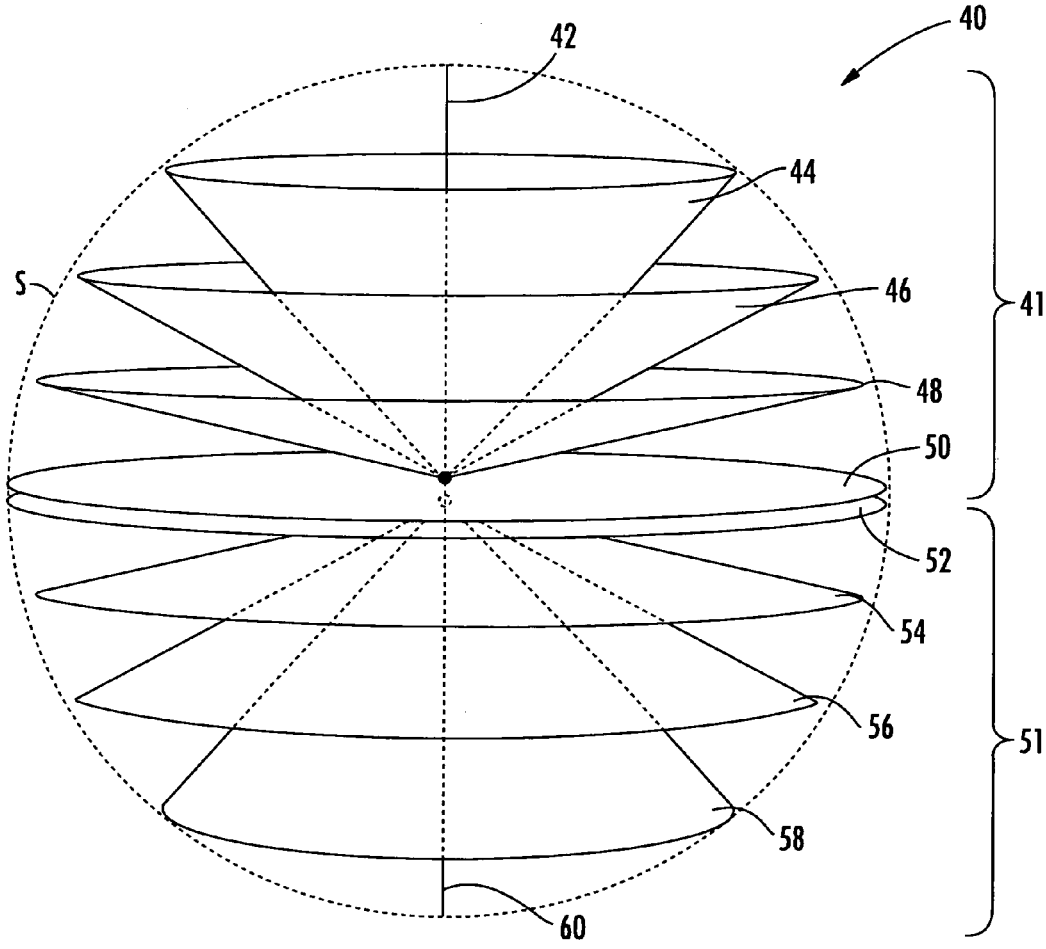
FIG. 4 is a schematic diagram of another embodiment of a dipole antenna according to the present invention.

Referring now to FIG. 4, another embodiment of the dipole antenna is shown. Each of the first and second antenna element assemblies 51, 41 may further include a respective disk antenna element 50, 52 and/or a respective filament antenna element 42, 60. Here, the first and second antenna element assemblies 51, 41 include a series of conical antenna elements 44, 46, 48 and 54, 56, 58 with each successive conical antenna element at least partially within a prior conical antenna element. Filament elements 42, 60, and disk elements 50, 52, are, of course, related to cones. They are cones with flare angles of 0 and 180 degrees respectively.

A method of making a dipole antenna includes arranging a first antenna element assembly 51 and a second antenna element assembly 41 in a dipole antenna configuration. Again, the first antenna element assembly 51 includes at least one conical antenna element 54, 56, 58, and the second antenna element assembly 41 includes a series of conical antenna elements 44, 46, 48 with each successive conical antenna element at least partially within a prior conical antenna element. Preferably, as shown, the first antenna assembly 51 also comprises a series of conical antenna elements 54, 56, 58, with each successive conical antenna element at least partially within a prior conical antenna element. Conical antenna elements 54, 56, and 58, may be said to be "nested" inside other.

An advantage of the present invention is the enhancement of antenna bandwidth. Multiple tuned antenna responses, of like kind to the polynomial responses of analog RF filters, occur when elements 54, 56, and 58, are slightly offset in size. For instance, enhanced bandwidth can be obtained from multiple nested cones, where each cone is analogous to filter pole.

Figure 6:
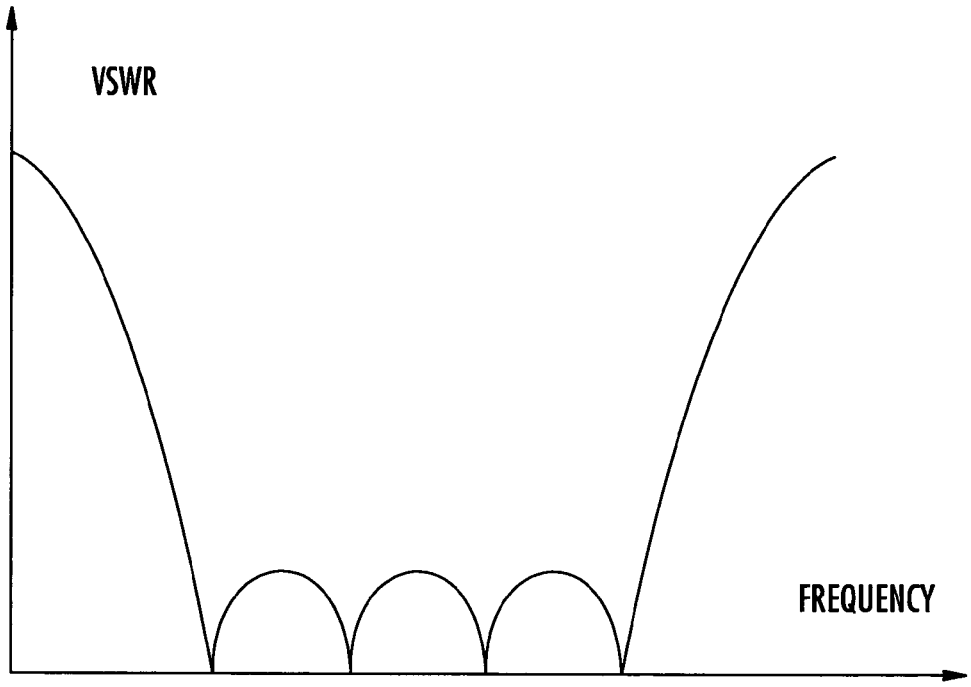
FIG. 6 is a diagram illustrating the frequency response of the present invention, in a multiple element embodiment.

FIG. 6 shows a frequency response of the present invention, in which broad VSWR bandwidth is obtained, by multiple tuned cones. In the example shown, a forth order Tchebyschev polynomial response is illustrated, with a controlled VSWR ripple, for which 4 cones are nested in each side of the dipole doublet.

Multiple tuning of the biconical antenna is particularly beneficial when the antenna mechanical envelope is not spherical or elliptical, such as would occur if the antenna is fit into a tall cylindrical radome of a small diameter. Such mechanical envelopes force the cones to be of small diameter and their individual bandwidth is therefore narrow. The second harmonic VSWR spike of a tall thin biconical antenna has been controlled by the addition of a second pair of nested coaxial cones tuned for this purpose.

Figure 1:
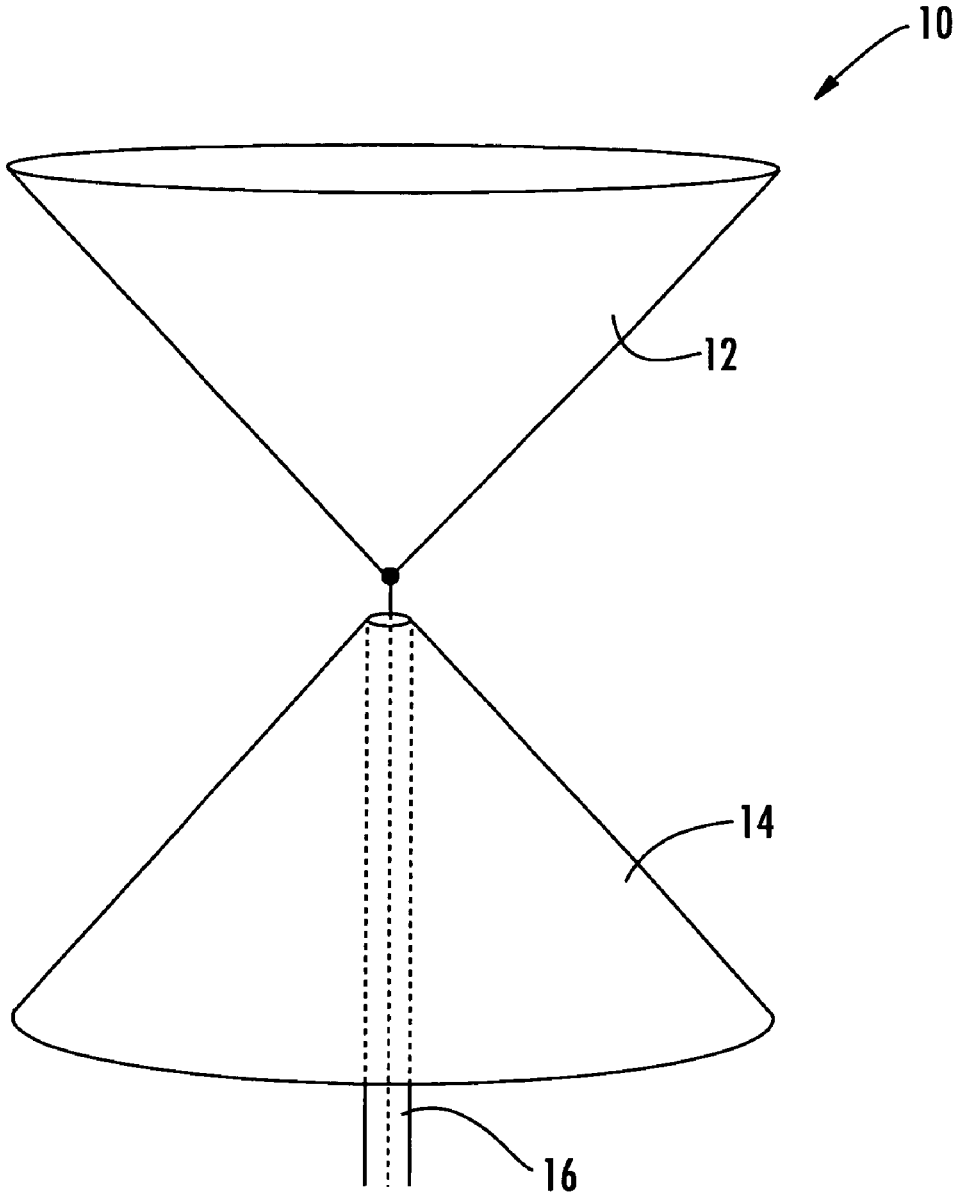
FIG. 1 (PRIOR ART)
FIG. 1 is a schematic diagram of a conventional biconical dipole antenna according to the prior art.
Figure 2:
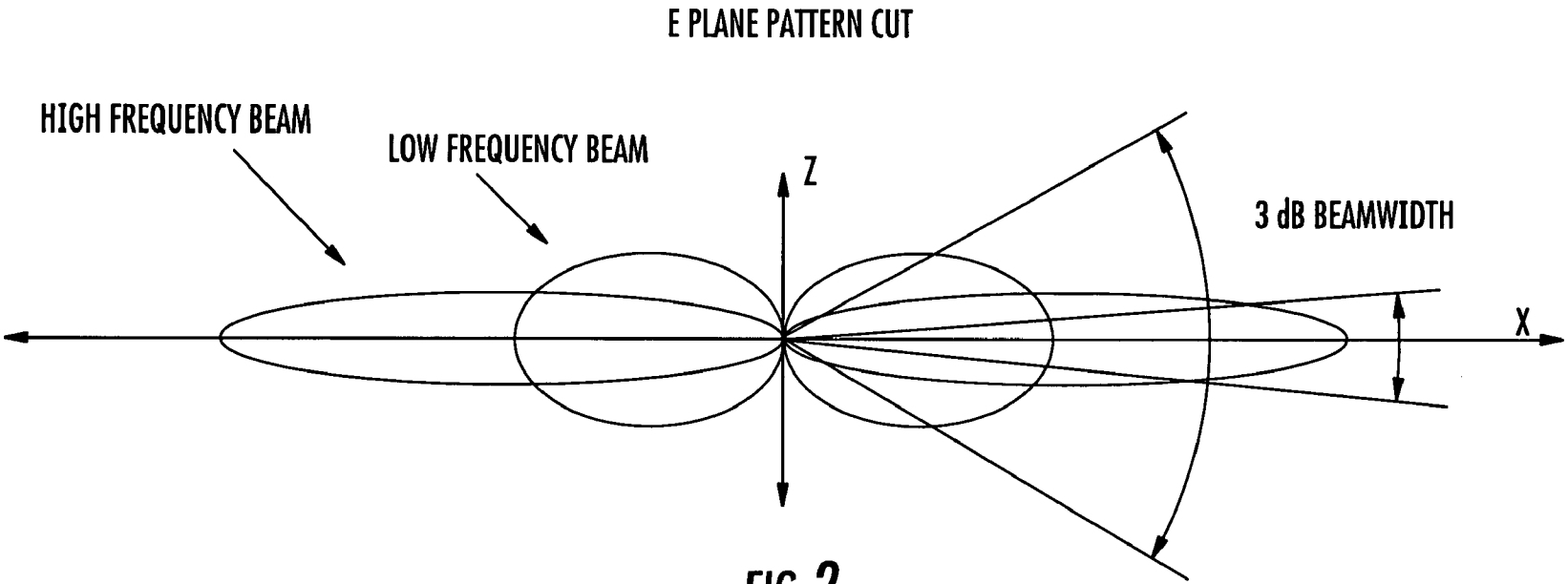
FIG. 2 is a diagram illustrating the relationship between frequency and beamwidth in the antenna of FIG. 1.

The multiple tuning feature of the present invention is especially beneficial for small cones of large flare angle, where the cones approximate or become flat discs. The FIG. 3 embodiment of this invention, comprising four cones, has about four times the VSWR bandwidth of the FIG. 1 conventional biconical dipole, when the small cones flatten to approximate flat discs. This is provided of course that the driving point resistance of the antennas are properly matched or referred to say, 50 ohms, by a transformer. The nested conical structure of the present invention provides the multiple resonances required for multiple tuning.

The invention is not so limited, as to require Tchebyschev polynomial frequency response, and the invention may be configured to provide, for example, a Butterworth polynomial response to eliminate passband ripple, and to reduce group delay or differential phase. Multiple tuning, in the present invention, can provide up to a $3\pi$ enhancement of antenna bandwidth, relative to single tuned biconical antennas, as described by Harold Wheeler in the paper "The Wide Band Matching Area For A Small Antenna", IEEE Transactions On Antennas and Propagation, Vol. AP-31, No. 2, March 1983, pp 364–367. Multiple tuning in the present invention is analogous to the multiple modes described in "Physical Limitations In Omni-Directional Antennas", L. J. Chu, Journal Of Applied Physics, Volume 19, December 1948, pp 1163–1175.

The polarity of successive nested cones also may be alternated to provide a sleeve monopole effect to the conical antenna system. That is, each successive nested cone may be fed 180 degrees out of phase with respect to each other.

The disc structures, 50 and 52 of FIG. 4, together describe a TEM patch antenna having a dipole pattern shape. Fundamental resonance occurs at disc diameters nominally ¼ wavelength, or about 0.19 to 0.24 wavelengths in practice.

Figure 5:
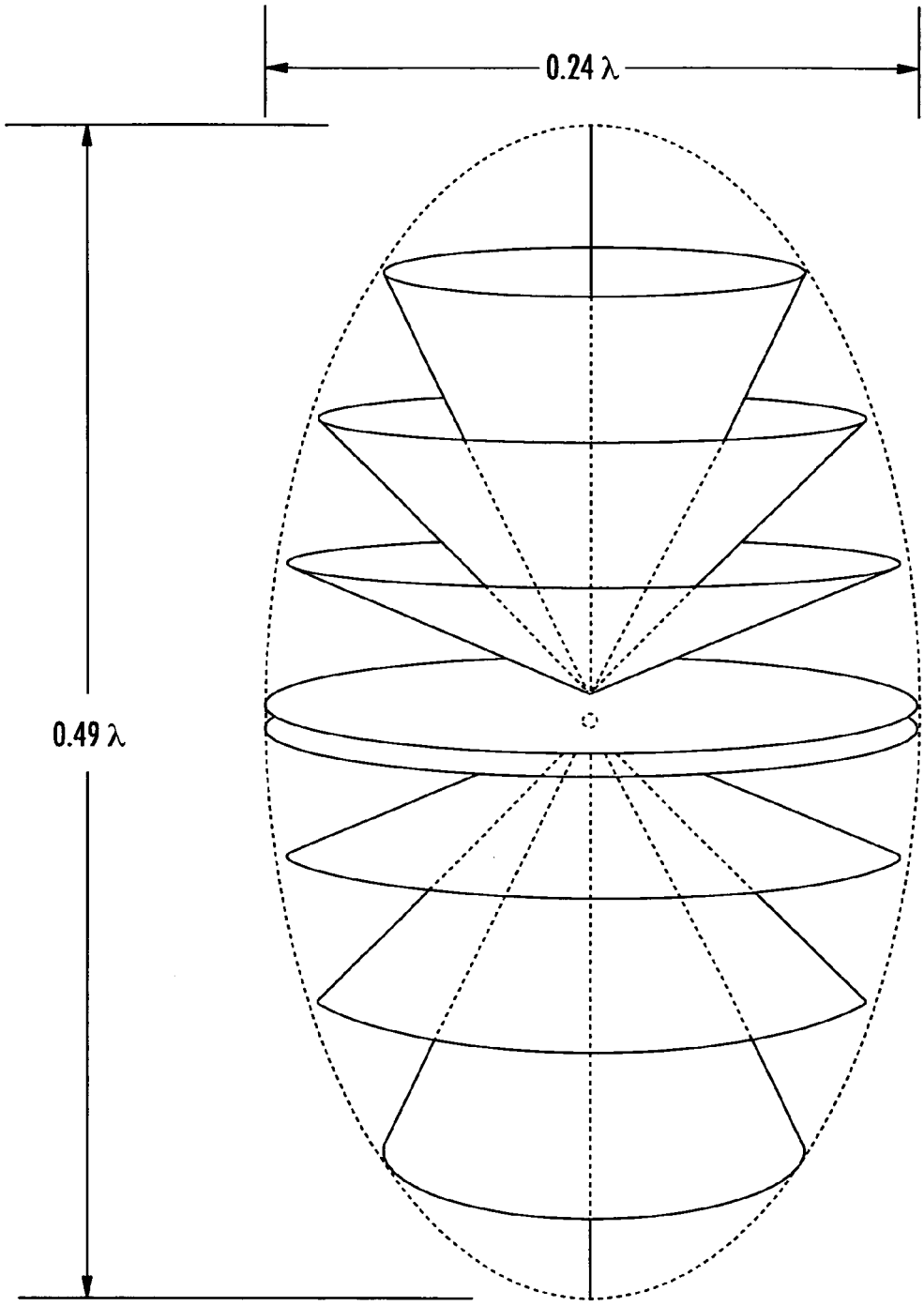
FIG. 5 is schematic diagram of another embodiment of the dipole antenna according to the present invention, illustrating dimensions of fundamental resonance.

The FIG. 5 embodiment of this invention is the system of dipole antennas in their respective dimensions for natural resonance. By itself, a thin wire dipole antenna will resonate at a length of near 0.49 wavelengths. A broadband biconical dipole, with a 120 degree flare angle, will have a lower cutoff with a height near 0.31 wavelengths. A double disk or TEM mode patch antenna will resonate at a diameter near 0.25 wavelengths. This invention is not so limited, however, as to require such dimensions, and the invention may readily be configured to any other dimensions by those skilled in the art.

This invention includes a method for designing dipole type antennas. FIG. 5 may be, for example, superimposed over a mechanical design envelope. If, say, an antenna is required to fit inside a hollow dielectric box, the box can be drawn in dimensions of wavelengths over the center of FIG. 5. The relationship between the conical dipoles and the mechanical envelope can readily be observed, and the designer can then pick a cone angle for the required bandwidth or driving impedance. Or, the required size of the enclosing box may be determined graphically.

There are, of course, many different types of bandwidth, including pattern bandwidth as pattern Beamwidth over frequency. The present invention allows the control of pattern beamwidth over frequency, when the nested cones are of successive size to "shed" the fields, such that the waves divorce from the cones are regular intervals in frequency.

In another embodiment, this invention may use antenna element assemblies 48 and 58, of FIG. 3, to provide a conical shaped radiation pattern, where the pattern in elevation is not on the horizon, or broadside to the axis of the cones, but rather oriented downwards slightly from omnidirectional. This is the so called "tilted beam" pattern, that is used for antennas on tall towers, to concentrate radiation slightly below the horizon. The multiple cones of this invention may also provide an enhanced balun effect, to reduce common mode current spillover onto a coax cable, following the axis of the conical antenna element assemblies.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is cliamed is:

1. A dipole antenna comprising:

a first antenna element assembly and a second antenna element assembly arranged in a dipole antenna configuration;

said first antenna element assembly comprising at least one conical antenna element;

said second antenna element assembly comprising a series of conical antenna elements with each successive conical antenna element at least partially within a prior conical antenna element and having a different flare angle than the prior conical antenna element.

2. A dipole antenna according to claim 1 wherein said first antenna assembly comprises a series of conical antenna elements with each successive conical antenna element at least partially within a prior conical antenna element.

3. A dipole antenna according to claim 2 wherein the series of conical antenna elements of said first and second antenna element assembly respectively comprise coaxially aligned conical antenna elements sharing a common apex.

4. A dipole antenna according to claim 3 wherein said first and second antenna assemblies each include a same number of conical antenna elements arranged in a symmetrical pattern.

5. A dipole antenna according to claim 2 wherein each of said first and second antenna dipole assemblies further comprises a respective disk antenna element.

6. A dipole antenna according to claim 5 wherein each of said first and second antenna dipole assemblies further comprises a respective filament antenna element.

7. A dipole antenna according to claim 6 wherein outer edge portions of said first and second antenna element assemblies lie along a common imaginary spherical surface.

8. A dipole antenna according to claim 7 further comprising an antenna feed point between the first and second antenna element assemblies; and wherein the imaginary spherical surface is centered on said antenna feed point.

9. A dipole antenna according to claim 1 wherein each of the conical antenna elements comprises a continuous conductive surface.

10. A dipole antenna according to claim 1 wherein each of the conical antenna elements comprises a wire structure.

11. A dipole antenna comprising:

a first antenna element assembly and a second antenna element assembly arranged in a dipole antenna configuration;

said first antenna element assembly comprising a series of conical antenna elements with each successive conical antenna element at least partially within a prior conical antenna element;

said second antenna element assembly comprising a series of conical antenna elements with each successive conical antenna element at least partially within a prior conical antenna element;

outer edge portions of said first and second antenna element assemblies lying along a common imaginary spherical surface.

12. A dipole antenna according to claim 11 wherein each of said first and second antenna dipole assemblies further comprises a respective disk antenna element.

13. A dipole antenna according to claim 11 wherein each of said first and second antenna dipole assemblies further comprises a respective filament antenna element.

14. A dipole antenna according to claim 11 further comprising an antenna feed point between the first and second antenna element assemblies; and wherein the imaginary spherical surface is centered on said antenna feed point.

15. A dipole antenna comprising:

a first antenna element assembly and a second antenna element assembly arranged in a dipole antenna configuration;

said first antenna element assembly comprising at least one conical antenna element;

said second antenna element assembly comprising at least one conical antenna element and a circular disk antenna element adjacent thereto;

said first and second antenna element assemblies having outer edge portions lying along a common imaginary spherical surface.

16. A dipole antenna according to claim 15 wherein said first antenna dipole assembly further comprises a second circular disk antenna element.

17. A dipole antenna according to claim 15 wherein each of said first and second antenna dipole assemblies further comprises a respective filament antenna element.

18. A dipole antenna according to claim 15 further comprising an antenna feed point between the first and second antenna element assemblies; and wherein the imaginary spherical surface is centered on said antenna feed point.

19. A dipole antenna comprising:

a first antenna element assembly and a second antenna element assembly arranged in a dipole antenna configuration;

said first antenna element assembly comprising at least one conical antenna element;

said second antenna element assembly comprising at least one conical antenna element and a filament antenna element adjacent thereto;

said first and second antenna element assemblies having outer edge portions lying along a common imaginary spherical surface.

20. A dipole antenna according to claim 19 wherein each of said first and second antenna dipole assemblies further comprises a second circular disk antenna element.

21. A dipole antenna according to claim 19 wherein said first antenna dipole assembly further comprises a second filament antenna element.

22. A dipole antenna according to claim 19 further comprising an antenna feed point between the first and second antenna element assemblies; and wherein the imaginary spherical surface is centered on said antenna feed point.

23. A method of making a dipole antenna comprising:

arranging a first antenna element assembly and a second antenna element assembly in a dipole antenna configuration;

said first antenna element assembly comprising at least one conical antenna element;

said second antenna element assembly comprising a series of conical antenna elements with each successive conical antenna element at least partially within a prior conical antenna element and having a different flare angle than the prior conical antenna element.

24. A method according to claim 23 wherein said first antenna assembly comprises a series of conical antenna elements with each successive conical antenna element at least partially within a prior conical antenna element.

25. A method according to claim 24 wherein each of said first and second antenna dipole assemblies further comprises a respective disk antenna element.

26. A method according to claim 25 wherein each of said first and second antenna dipole assemblies further comprises a respective filament antenna element.

27. A method according to claim 26 wherein outer edge portions of said first and second antenna element assemblies lie along a common imaginary spherical surface.

28. A method according to claim 27 further comprising providing an antenna feed point between the first and second antenna element assemblies; and wherein the imaginary spherical surface is centered on the antenna feed point.

29. A dipole antenna comprising:

a first antenna element assembly and a second antenna element assembly arranged in a dipole antenna configuration;

said first antenna element assembly comprising a series of conical antenna elements with each successive conical antenna element at least partially within a prior conical antenna element;

a respective disk antenna element adjacent the series of conical antenna elements; and a respective filament antenna element adjacent the series of conical antenna elements;

said second antenna element assembly comprising a series of conical antenna elements with each successive conical antenna element at least partially within a prior conical antenna element;

a respective disk antenna element adjacent the series of conical antenna elements; and a respective filament antenna element adjacent the series of conical antenna elements.

30. A method of makding a dipole antenna comprising:

arranging a first antenna element assembly and a second antenna element assembly in a dipole antenna configuration;

said first antenna element assembly comprising a series of conical antenna elements with each successive conical antenna element at least partially within a prior conical antenna element;

a respective disk antenna element adjacent the series of conical antenna elements; and a respective filament antenna element adjacent the series of conical antenna elements;

said second antenna element assembly comprising a series of conical antenna elements with each successive conical antenna element at least partially within a prior conical antenna element;

a respective disk antenna element adjacent the series of conical antenna elements; and a respective filament antenna element adjacent the series of conical antenna elements.

* * * * *